US007048224B2

(12) United States Patent
Allgood

(10) Patent No.: US 7,048,224 B2
(45) Date of Patent: May 23, 2006

(54) WAVE-CUT OVERLAPPING TRASH BAGS

(75) Inventor: Charles D. Allgood, Arlington, TX (US)

(73) Assignee: Olympic General Corporation, Grand Prairie, TX (US)

( * ) Notice: Subject to any disclaimer, the term of this patent is extended or adjusted under 35 U.S.C. 154(b) by 97 days.

(21) Appl. No.: 10/644,326

(22) Filed: Aug. 20, 2003

(65) Prior Publication Data

US 2005/0040278 A1 Feb. 24, 2005

(51) Int. Cl.

| | |
|---|---|
| ***B65H 18/08*** | (2006.01) |
| ***B65H 18/28*** | (2006.01) |
| ***B31B 23/14*** | (2006.01) |
| ***B31B 23/26*** | (2006.01) |
| ***B31B 23/96*** | (2006.01) |

(52) U.S. Cl. ..... 242/526.1; 353/521; 353/528; 353/534; 353/160.4; 493/196; 493/234; 493/14; 206/390

(58) Field of Classification Search ..... 242/521, 242/526.1, 526.3, 528, 534, 160.4; 493/14, 493/18, 196, 197, 233, 234, 230, 238; 206/390
See application file for complete search history.

(56) References Cited

U.S. PATENT DOCUMENTS

| | | | | |
|---|---|---|---|---|
| 4,925,438 | A * | 5/1990 | Wagner | 493/194 |
| 5,215,275 | A * | 6/1993 | Gold | 242/526.1 |
| 5,390,875 | A * | 2/1995 | Gietman et al. | 242/528 |
| 5,421,802 | A * | 6/1995 | Landeck et al. | 493/14 |
| 5,683,340 | A * | 11/1997 | Belias et al. | 493/196 |
| 5,993,368 | A * | 11/1999 | Benovitz et al. | 493/196 |
| 6,113,526 | A * | 9/2000 | Lotto | 493/234 |
| 6,168,558 | B1 * | 1/2001 | Vinberg | 493/196 |
| 2002/0020648 | A1 * | 2/2002 | Lam et al. | 206/390 |

* cited by examiner

*Primary Examiner*—John M. Jillions
(74) *Attorney, Agent, or Firm*—Michael A. O'Neil

(57) ABSTRACT

A process for assembling wave-cut trash bags for overlapping dispensing includes the steps of providing a flattened blown-film polymeric tube; providing sets of closely spaced, parallel seals extending across the entire width of the flattened blown-film polymeric tube at periodic intervals there along; providing a transversely extending line of perforations between the seals comprising each set of closely spaced, parallel seals; and providing a wave shaped line of perforations extending transversely across the entire width of the flattened blown-film polymeric tube at a location equidistance between adjacent closely spaced, parallel sets of seals. The flattened blown-film polymeric tube is separated along each transversely extending line of perforations and along each wave shaped line of perforations after which the leading end of each following trash bag is positioned in an overlapping relationship with the trailing end of the preceding trash bag to facilitate overlapping dispensing.

6 Claims, 6 Drawing Sheets

WAVE-CUT OVERLAPPING TRASH BAGS

TECHNICAL FIELD

This invention relates generally to the manufacture, distribution, and utilization of trash bags, and more particularly to the dispensing of overlapping wave-cut trash bags.

BACKGROUND AND SUMMARY OF THE INVENTION

Trash bags are utilized throughout the world for refuse collection and disposal, storage, and other purposes. Most trash bags are manufactured by the blown-film extrusion process which includes forming a blown-film tube from polyethylene or other polymeric materials, flattening the blown-film tube, and then segregating the flattened tube into individual trash bags by forming seals which extend transversely across the entire width of the tube. Typically a line of perforations is formed immediately adjacent and parallel to each seal to facilitate separation of the trash bags one from another. After the trash bags are sealed and perforated, they are typically twice-folded axially into a fractional width configuration.

Traditionally, trash bags have been manufactured and sold in rolls comprised of individual trash bags connected end to end. The rolls of end-to-end connected trash bags are packaged in boxes or suitable containers for distribution. Whenever a trash bag is needed, the consumer unwinds the outermost trash bag from the roll and then separates the trash bag from the roll by tearing the line of perforations which connect it to the following bag of the roll.

More recently overlapping trash bag dispensing has evolved. In accordance with the overlapping dispensing technique, trash bags that otherwise would be connected end-to-end are separated from one another at the point of manufacture. Following separation the leading end of each following trash bag is positioned in an overlapping relationship with the trailing end of the preceding trash bag prior to the winding of the trash bags into a roll. The completed rolls of trash bags are positioned in containers having slots formed therein which extend parallel to the axis of the roll. Whenever it is desired to remove a trash bag from the roll, the leading end of the outermost trash bag on the roll is pulled through the slot in the container thereby disengaging the trash bag from the roll and simultaneously pulling the leading end of the next trash bag of the roll through the slot. This results in making the next succeeding trash bag readily available whenever it may be needed.

In the case of trash bags which are rectangular in shape at both ends, the separation of a following trash bag from the next preceding trash bag and the positioning of the leading end of the following trash bag in an overlapping relationship with respect to the trailing end of the preceding trash bag is relatively straightforward. As indicated above, trash bags are typically folded at least twice axially into a multi-layer, fractional width configuration prior to being wound into rolls. Even with the trash bags folded into as many as four layers, it is feasible to direct a signal, typically an electric spark, through the perforations situated next to the seal which separates the leading and following trash bags. The signal passes through the perforations and engages a suitable target which triggers the steps involved in separating the following trash bag from the leading trash bag and positioning the leading end of the following trash bag in an overlapping relationship with the trailing end of the leading trash bag.

It is also known to provide wave-cut trash bags. A wave-cut trash bag has a wave or lobe-shaped configuration at its open end. This provides two or more lobes which can be used to tie the trash bag in a closed configuration after it is filled.

Edge-type wave-cut trash bags are manufactured by providing closely spaced, parallel transversely extending seals at predetermined intervals along the length of a flattened blown film polymeric tube. A transversely extending line of perforations is provided between the closely spaced, parallel seals. The flattened blown film tube is then separated longitudinally along a wave or lobe-shaped line located equidistant between the edges of the tube.

It is known that edge-type wave-cut trash bags can be assembled overlapping dispensing on a roll in the same manner described hereinabove in conjunction with conventional trash bags.

End-type wave-cut trash bags are manufactured by providing sets of closely spaced, parallel transversely extending seals at predetermined intervals along the length of a flattened blown-film polymeric tube. A transversely extending line of perforations is provided between the closely spaced, parallel seals. A wave or lobe-shaped line of perforation is formed across the flattened blown-film tube at a location equidistant between successive sets of spaced, parallel seals.

Prior to the present invention at least three factors have prevented the successful application of overlapping dispensing to end-type wave-cut trash bags on a roll. First, because wave-cut trash bags are folded axially into a fractional width configuration, the lobe or wave-shaped line of perforations which define the open ends of the trash bags are non-aligned. This fact negates the traditional method of identifying trash bag ends by directing a signal through perforations comprising all of the trash bag layers. Second, the perforations which are utilized to separate adjacent trash bags comprising a flattened blown-film polymeric tube are traditionally evenly spaced. However, it has been found that the use of evenly spaced perforations at the lobe or wave-shaped ends of wave-cut trash bags results in force concentrations which in turn causes skewing of the trash bags when wave-cut trash bags are separated longitudinally to facilitate the overlapping dispensing process. Third, when wave-cut trash bags are folded axially to provide a fractional width configuration and are subsequently separated longitudinally to facilitate overlapping dispensing, one of the lobes of the wave-cut open end of the trash bag forms a single layer extension which must be manipulated in order to position the leading end of the following trash bag in an overlapping relationship with the trailing end of the preceding trash bag. Heretofore it has not been considered possible to utilize the traditional air current technique to manipulate the single polymeric layer.

The present invention overcomes the foregoing and other problems which have long since characterized the prior art. In accordance with the broader aspects of the invention, identification of the lines of perforations which separate adjacent trash bags is accomplished by positioning a signal receiving target between the folds defining the layers of the trash bag thereby eliminating the requirement of directing a perforation identifying signal through all of the layers comprising the trash bag. The line of perforations connecting the open ends of wave-cut trash bags are arranged in accordance with a predetermined pattern thereby avoiding stress concentrations and preventing skewing of the trash bags when the trash bags are separated longitudinally to facilitate the overlapping dispensing procedure. Manipulation of the separated trash bag ends to facilitate the overlapping dispensing process will be facilitated by selectively applying static electricity to the trash bag ends thereby temporarily bonding the layers comprising the trash bag one to another.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1A:
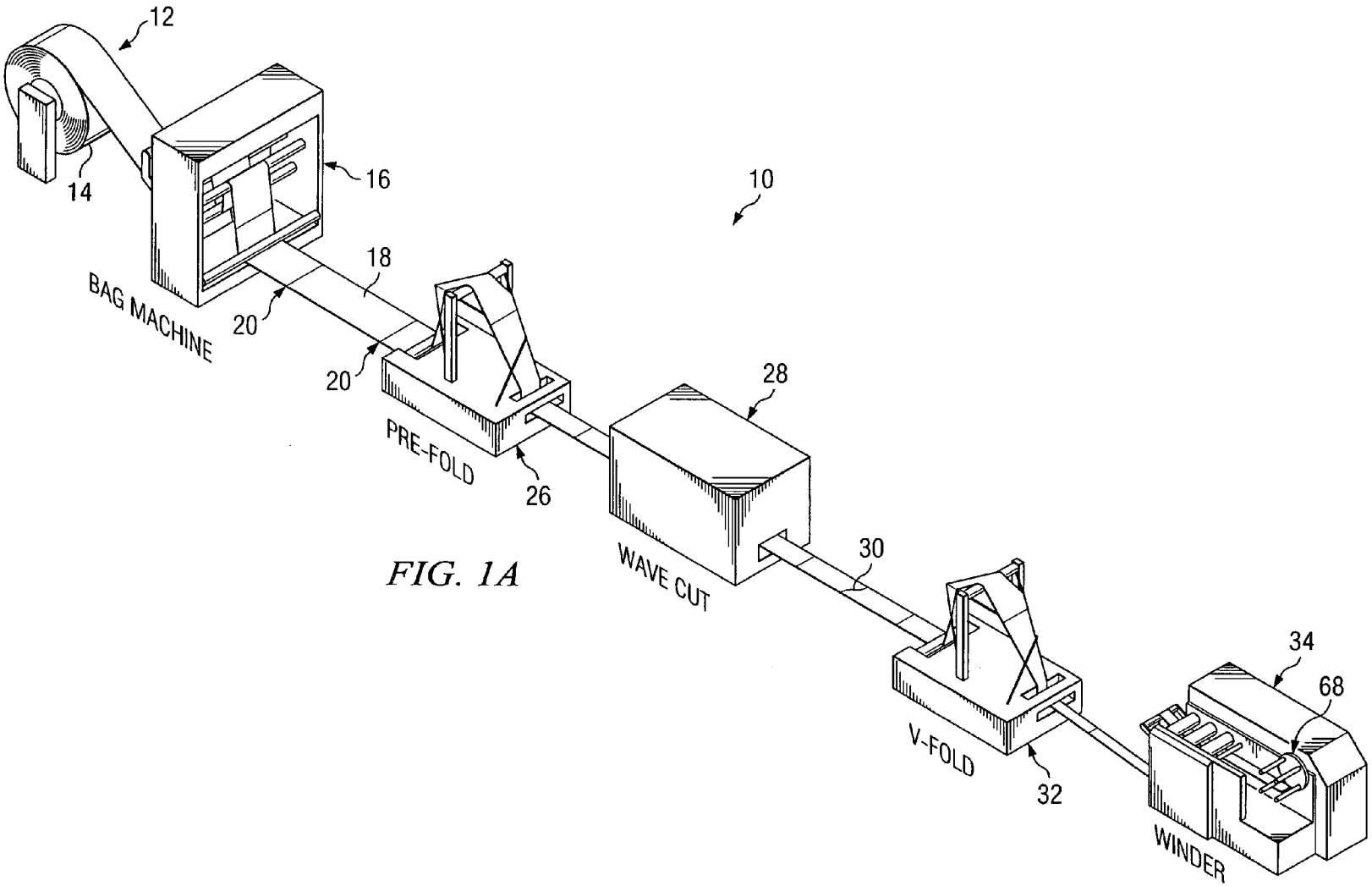
FIG. 1A is a front perspective view of an apparatus for facilitating the process of the present invention.

Referring now to the Drawings, and particularly to FIGS. 1A, 1B, 2, and 3, there is shown a system 10 for implementing the process of assembling wave-cut trash bags for overlapping dispensing comprising the present invention. The system 10 receives a flattened blown-film polymeric tube 12 from a suitable source 14. The source 14 is illustrated in FIG. 1A as comprising a coil from which the flattened blown-film polymeric tube 12 is directed into the system 10. However, as will be appreciated by those skilled in the art, the system 10 does not necessarily receive the flattened blown-film polymeric tube 12 from a coil; the system may also receive the flattened polymeric film directly from the source thereof.

The flattened blown-film polymeric tube 12 is first directed into a bag machine 16 which separates the flattened blown-film polymeric tube 12 into sequential sections 18. The sections 18 are separated one from another by equally spaced seal/perforation zones 20.

Figure 7:
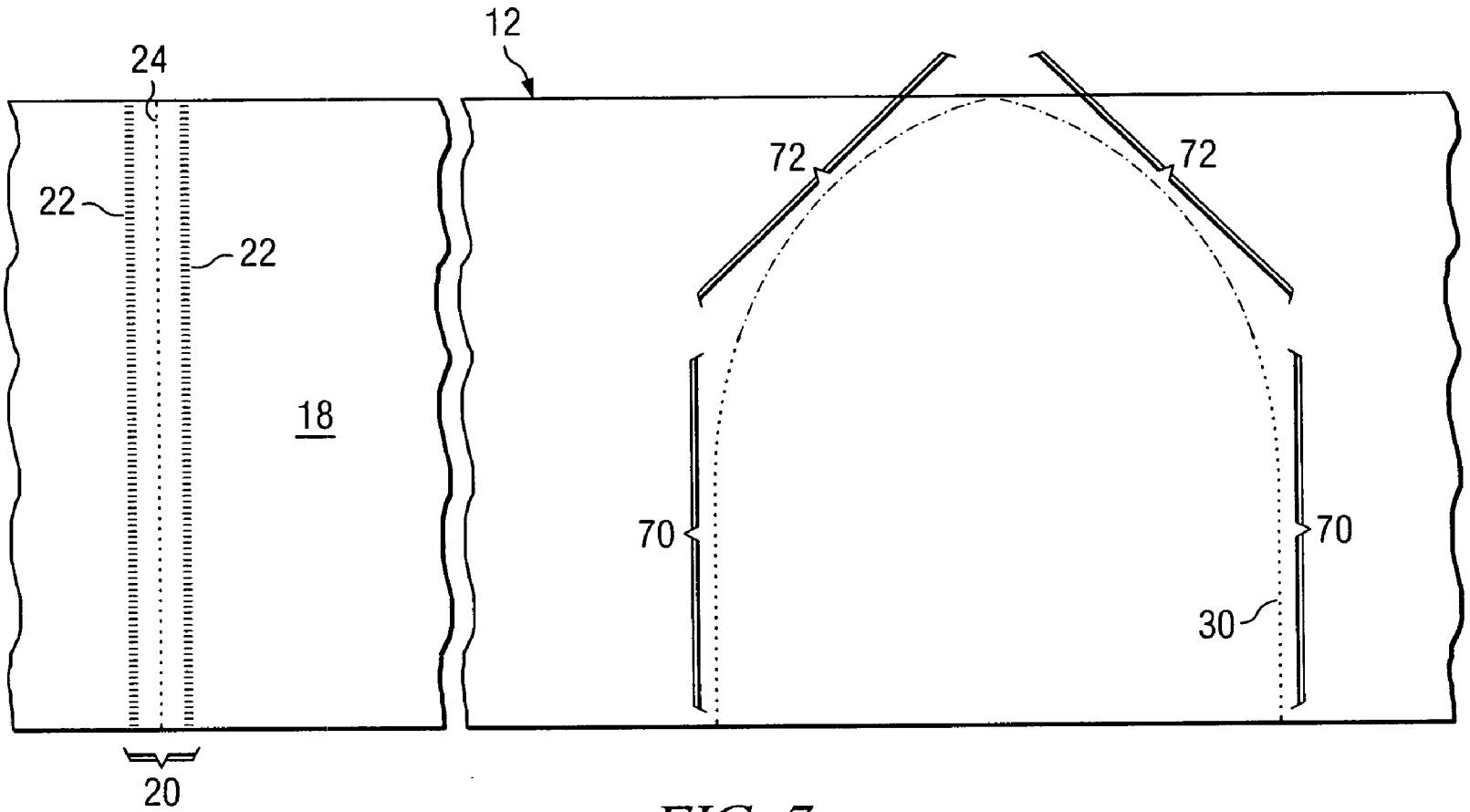
FIG. 7 is a top view of a flattened blown-film polymeric tube constructed in accordance with the process of the present invention.

Referring momentarily to FIG. 7, each seal/perforation zone 20 comprising the flattened blown-film polymeric tube 12 comprises a set of spaced, parallel seals 22 which extend transversely across the entire width of the flattened blown-film polymeric tube 12. The seals 22 are typically formed by heat sealing, however, other sealing techniques may also be employed in the practice of the invention. Each seal/perforation zone 20 further comprises a line of uniformly spaced perforations 24 situated equidistant between the seals 22.

The seals 22 may be formed by positioning a heated bar on one side and a cooperating anvil on the opposite side of the flattened tube 12. The heated bar engages the flattened tube 12 under predetermined pressure thereby softening the material of the tube 12 sufficiently to form a permanent bond between the opposite sides thereof. The line of perforation 24 is formed by positioning a toothed bar and a cooperating anvil on opposite sides of the flattened tube 12. The tooth bar is advanced into engagement with the underlying anvil thereby forming the perforations comprising the line of perforations 24. As will be appreciated by those skilled in the art, various other procedures may be utilized to form the seals and/or the perforations comprising the seal/perforation zone 20.

Referring again to FIG. 1A, the flattened blown-film polymeric tube 12 is directed from the bag machine 16 to a prefolding machine 26 which forms a first longitudinally extending fold in the flattened blown-film polymeric tube 12 whereby the tube 12 assumes a reduced width configuration. From the prefolding machine 26, the now once folded flattened blown-film polymeric tube 12 is directed to a wave cutting machine 28 which forms a lobe or wave-shaped line of perforations 30 in the tube 12. The line of perforations 30 is situated equidistant between adjacent seal/perforation zones 20 comprising the flattened blown-film polymeric tube 12.

The lobe or wave shaped line of perforation 30 may be formed by positioning a star wheel having a toothed periphery and an anvil wheel having a flat periphery on opposite sides of the flattened tube 12. The star wheel is advanced into engagement with the anvil wheel thereby initially perforating the flattened tube 12. While the star wheel and the anvil wheel remain in engagement, they are moved laterally across the width of the tube 12 following a curvilinear path thereby forming the lobe or wave shaped line of perforations 30. Other techniques for forming the lobe or wave shaped line of perforations will readily suggest themselves to those skilled in the art.

Figure 1B:
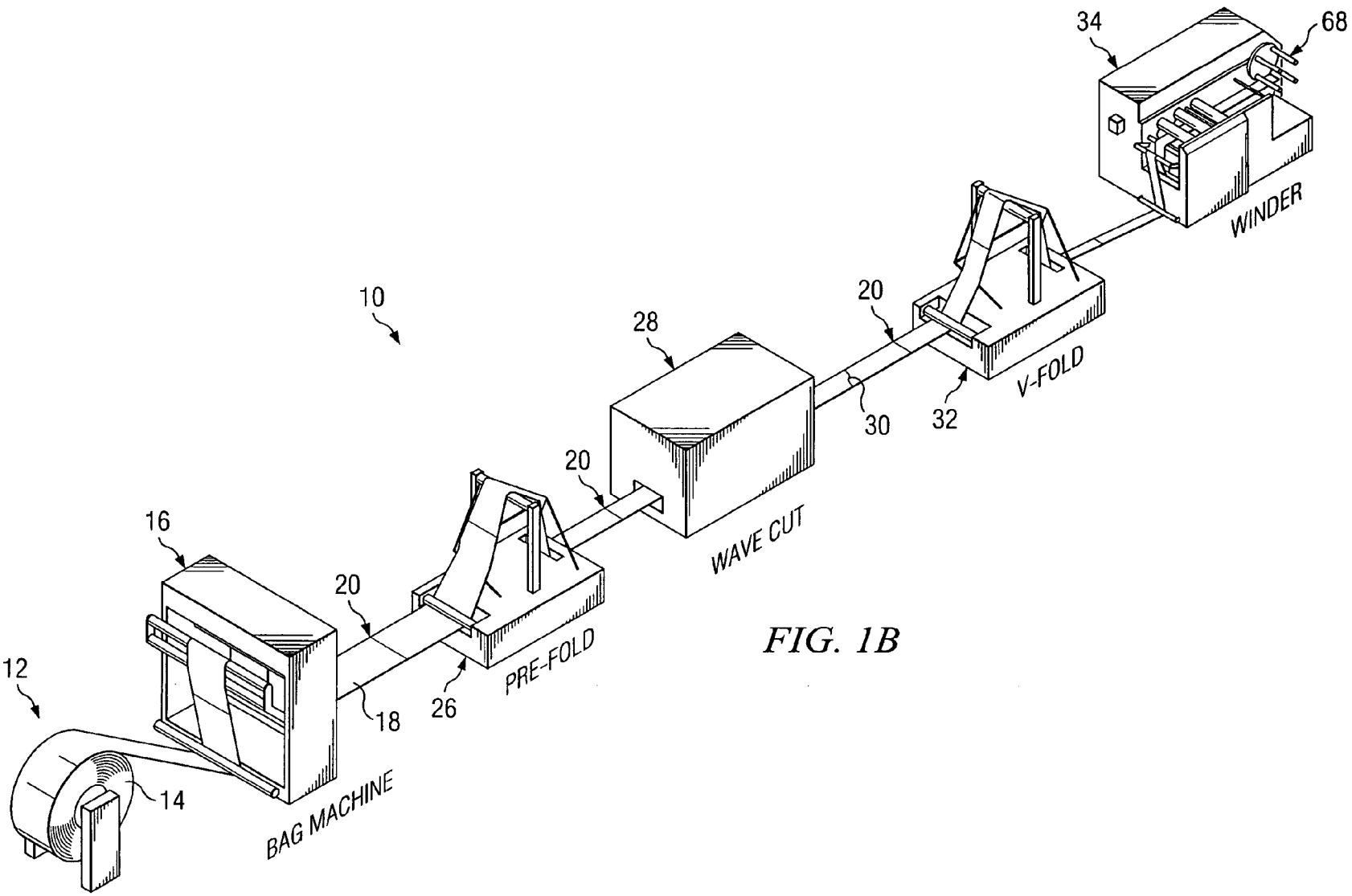
FIG. 1B is a rear prospective view of the apparatus of FIG. 1A.

Referring simultaneously to FIGS. 1A and 1B, the flattened blown-film polymeric tube 12 now having the lobe or wave-shaped lines of perforations 30 formed therein is directed from the wave cutting machine 28 to a V-folding machine 32. The V-folding machine 32 forms a second longitudinally extending fold in the flattened blown-film polymeric tube 12 whereby the tube 12 comprises a multilayer, fractional width configuration. From the V-folding machine 32, the flattened blown-film polymeric tube 12 is directed to a winding machine 34.

The winding machine 34 performs three functions with respect to the flattened blown-film polymeric tube 12. First, the winding machine 34 separates the tube 12 at each perforation line 24 and at each perforation line 30 thereby transforming the tube 12 into a series of individual trash bags each having a seal 22 at one end and a wave-cut opening defined by the line of perforation 30 at the opposite end. Second, the winding machine 34 positions the leading end of each following trash bag in an overlapping relationship with the trailing end of the preceding trash bag thereby facilitating overlapping dispensing of the trash bags formed from the flattened blown-film polymeric tube 12. Third, the winding machine 34 winds the trash bags into a roll for subsequent packaging and delivery to the ultimate consumer.

Figure 2:
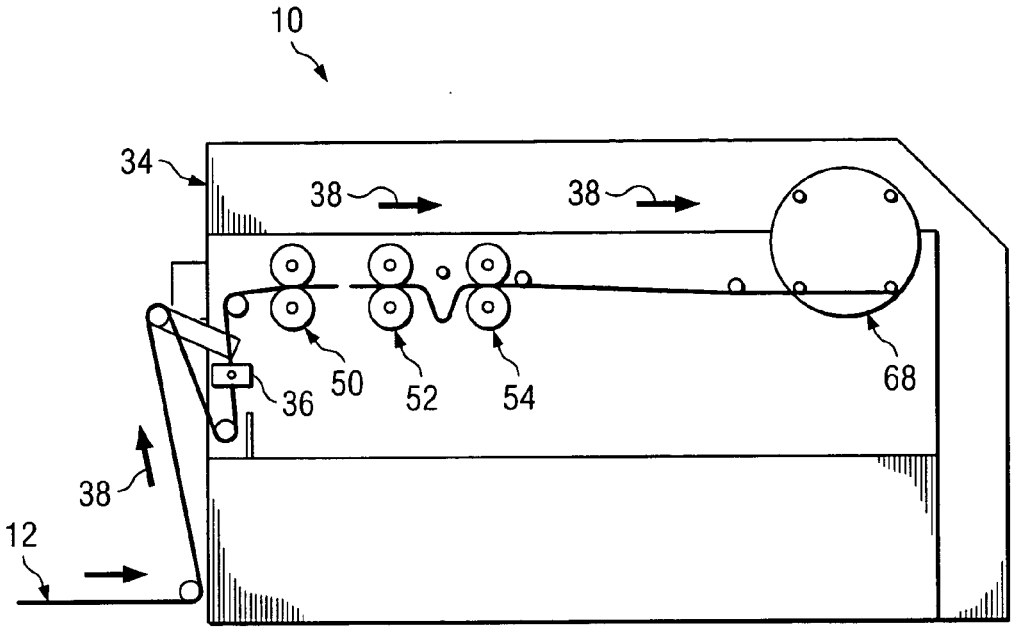
FIG. 2 is a side view of part of the apparatus of FIGS. 1A and 1B.
Figure 3:
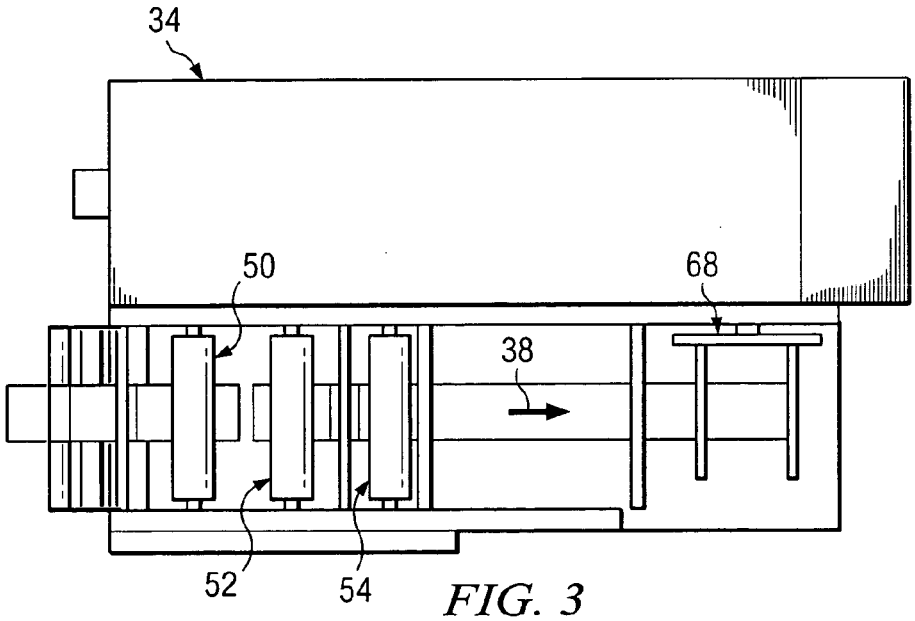
FIG. 3 is a top view of the apparatus of FIG. 2.
Figure 4:
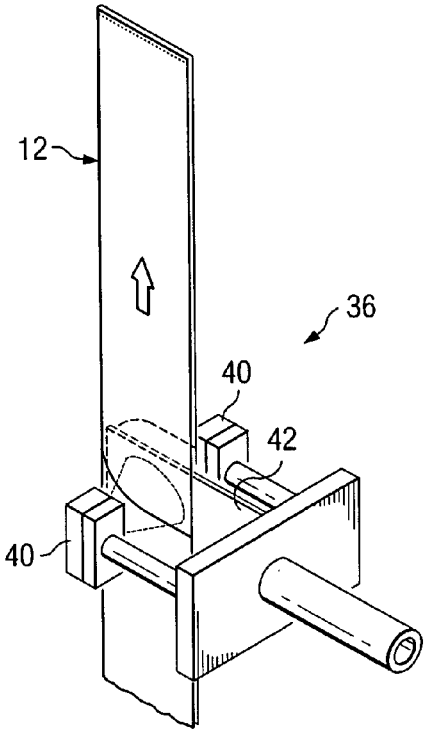
FIG. 4 is a perspective view of a first embodiment of the perforation detecting device comprising the apparatus of FIGS. 1A and 1B.
Figure 5:
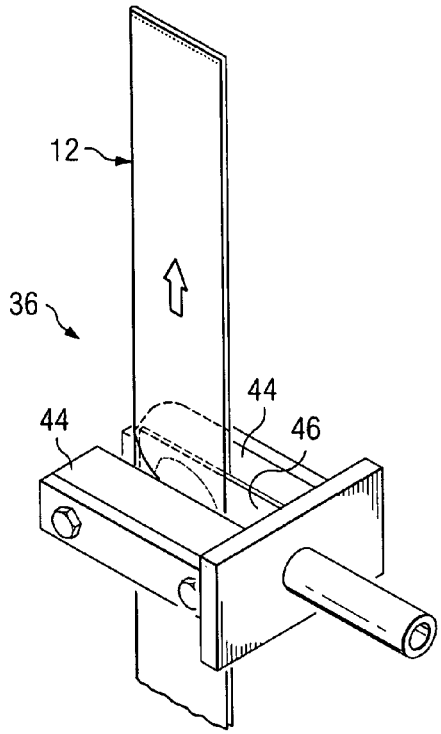
FIG. 5 is a perspective view of an alternative embodiment of the perforation detecting apparatus.
Figure 6A:
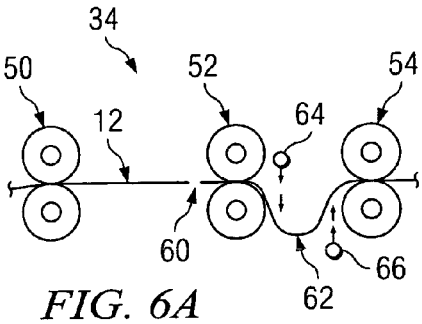
FIG. 6A is a diagrammatic illustration of an initial step in the process of the present invention.
Figure 6B:
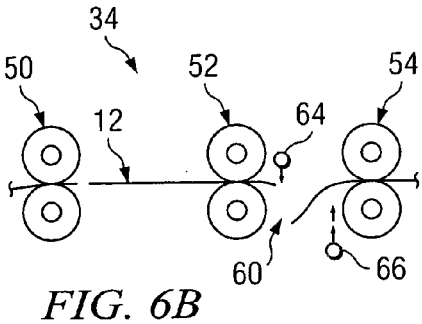
FIG. 6B is a diagrammatic illustration of a later step in the process of the present invention.
Figure 6C:
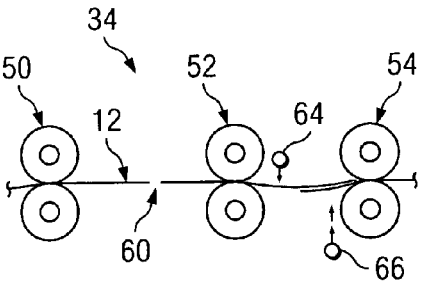
FIG. 6C is a diagrammatic illustration of a still later step in the process of the present invention.
Figure 6D:
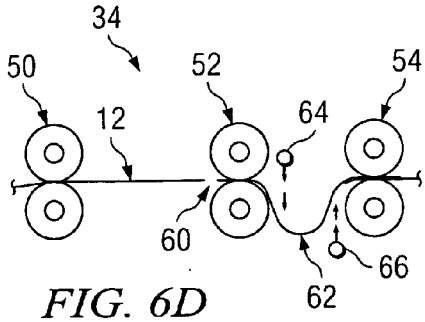
FIG. 6D is a diagrammatic illustration of a still later step in the process of the present invention.

Referring to FIGS. 2, 4, and 5, the winding machine 34 includes a perforation sensor 36 which is utilized to sense the lines of perforations 24 and the lines of perforations 30 as the flattened blown-film polymeric tube 12 moves through the winding machine 34 in the direction of the arrows 38. Referring specifically to FIG. 4, the perforation sensor 36 may include signal generators 40 situated on opposite sides of the tube 12 as it moves through the winding machine 34. The signal generators 40 direct signals, which may comprise laser beams, infrared beams, or other types and kinds of electromagnetic signals into engagement with the outermost surfaces of the moving tube 12 and through the perforations formed therein. A signal receiving target 42 is positioned between the layers comprising the tube 12 as formed therein by the prefolding machine 26 and the V-folding machine 32 and is actuated by signals from the signal generators 40 passing through the perforations formed in the tube 12. In this manner each line of perforations formed in the tube 12 is precisely identified.

Referring specifically to FIG. 5, the perforation sensor 36 may instead comprise spark generators 44 situated on opposite sides of the tube 12 as it moves through the winding machine 34. The spark generators 44 direct signals, which comprise electric sparks into engagement with the outermost surfaces of the moving tube 12 and through the perforations formed therein. A signal receiving target 46 is positioned between the layers comprising the tube 12 as formed therein by the prefolding machine 26 and the V-folding machine 32 and is actuated by signals from the spark generators 44 passing through the perforations formed in the tube 12. In this manner each line of perforations formed in the tube 12 is precisely identified.

Having reference to FIGS. 2, 3, 6A, 6B, 6C, and 6D, the winding machine 34 further includes three sets of rollers 50, 52, and 54 which function to separate the flattened blown-film polymeric tube 12 into individual trash bags and to position the leading edge of each following trash bag in an overlapping relationship to the trailing end of the preceding trash bag. As is best shown in FIGS. 6A, 6B, 6C, and 6D, the rollers 50 and 52 form a separation 60 between the trailing end of each preceding bag and the leading end of each following bag comprising the flattened blown-film polymeric tube 12. Each trash bag comprising the tube 12 is formed into a semi-loop 62 as it passes between the rollers 52 and 54. Nozzles 64 produce downwardly directed air jets while nozzles 66 produce upwardly directed air jets. As the gap 60 between preceding and following trash bags enters the zone between the rollers 52 and 54, the air jets emanating from the nozzle 64 push the leading end of the following trash bag downwardly while the air jets emanating from the nozzle 66 push the trailing end of the preceding trash bag upwardly. Meanwhile, the rollers 52 advance the leading end of the following trash bag into an overlapping relationship with the trailing end of the preceding trash bag thereby facilitating overlapping dispensing of the trash bags. From the rollers 52 the flattened blown-film polymeric tube 62 now having the leading end of each following trash bag positioned in an overlapping relationship with the trailing end of the preceding trash bag are directed to the winding mechanism 68 of the winding machine 34.

Referring to FIG. 7, the perforations comprising the line of perforations 24 of the seal/perforation zone extending between adjacent trash bags comprising the flattened blown-film polymeric tube 12 are uniformly spaced. However, the lobe or waved-shaped lines of perforations 30 extending between adjacent trash bags comprising the tube 12 are arranged in accordance with a predetermined pattern in order to prevent skewing of the trash bags when they are separated one from another in the operation of the winding machine 34. For example, the perforations within the zone 70 of each line of perforation 30 may be closely and evenly spaced while the perforations comprising the zones 72 may be widely and/or non-uniformly spaced. Other perforation arrangements capable of preventing skewing of the trash bags when they are separated one from another will readily suggest themselves to those skilled in the art.

Figures 8A, 8B:
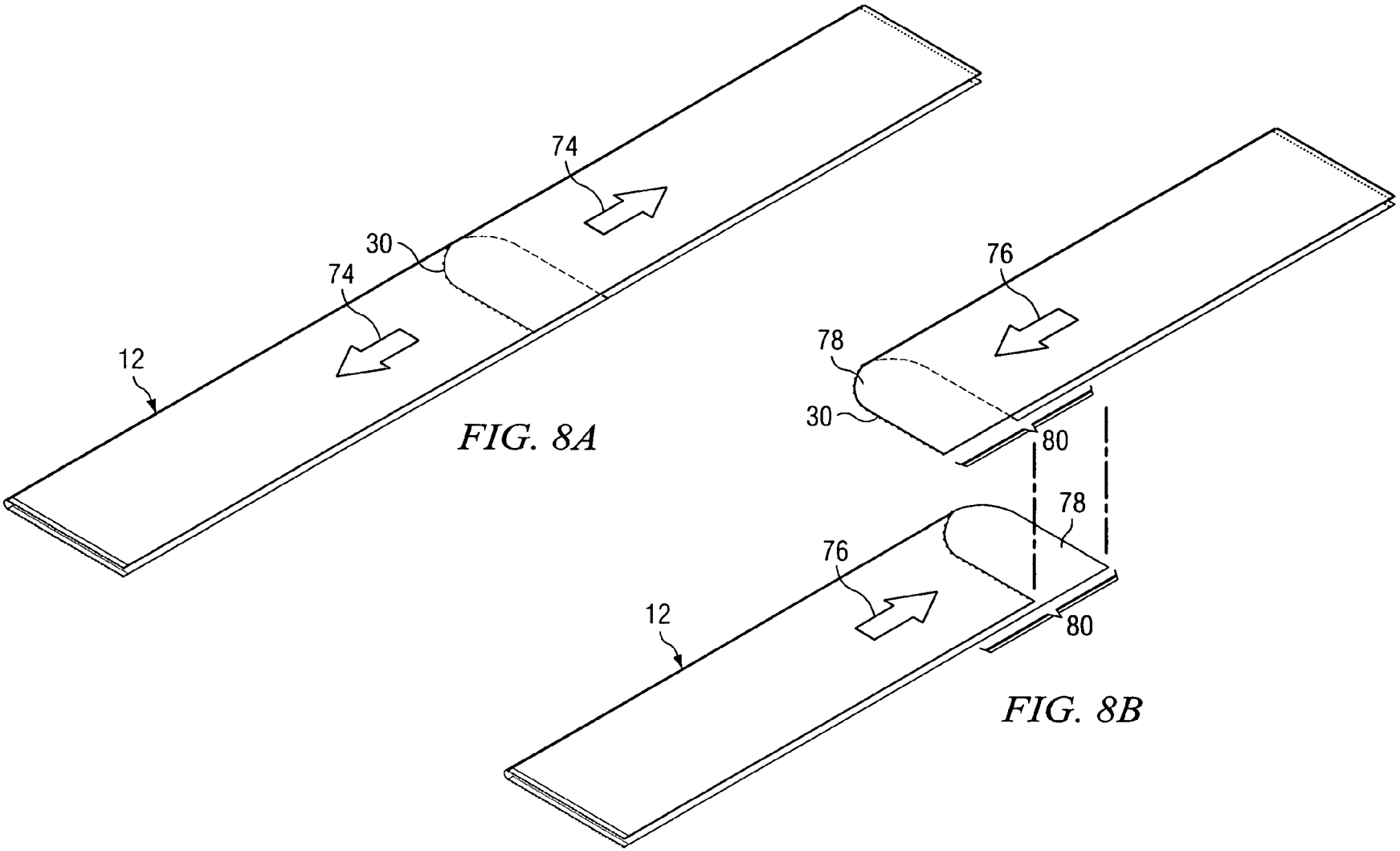
FIG. 8A is an illustration of the separation of adjacent trash bags in accordance with the process of the present invention.
FIG. 8B is an illustration of the leading end of a following trash bag positioned in an overlapping relationship with respect to the trailing end of a preceding trash bag in accordance with the process of the present invention.

Referring to FIGS. 8A and 8B, the arrows 74 represent the opposed longitudinally directed forces which are utilized to separate adjacent trash bags comprising the flattened blown-film polymeric tube 12 along the lobe or wave-shaped lines of perforations 30. Following the separation step the leading end of each following trash bag and the trailing end of each preceding trash bag are positioned in an overlapping relationship as indicated by the arrows 76. Because the trash bags comprising the tube 12 are folded axially into a fractional width configuration prior to separation thereof, the separation step results in single layer lobes 78 at the trailing end of each preceding trash bag and at the leading edge of each following trash bag. In order to facilitate positioning of the leading end of each following trash bag in an overlapping relationship with the trailing end of each preceding trash bag under the action of the air jets emanating from the nozzles 64 and 66, an electrostatic field may be applied to the leading and trailing ends of adjacent trash bags within zones 80.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A process for assembling wave-cut trash bags for overlapping dispensing including the steps of:

providing a flattened blown-film polymeric tube;

providing sets of closely spaced, parallel seals extending transversely across the entire width of the flattened blown-film polymeric tube at equally spaced intervals therealong;

providing a line of perforations extending transversely across the entire width of the flattened blown-film polymeric tube between the closely spaced, parallel seals comprising each set thereof;

providing a wave shaped line of perforations extending across the entire width of the flattened blown-film polymeric tube at a location equidistant from each of the closely spaced, parallel sets of seals;

folding the flattened blown-film polymeric tube axially into a multi-layer, fractional width configuration;

positioning a signal receiving target between the layers of the folded flattened blown-film polymeric tube;

directing a signal through the transversely extending line of perforations positioned between the closely spaced, parallel seals and through the perforations comprising the wave-cut line of perforations and thereby locating each end of each trash bag comprising the flattened blown-film polymeric tube;

applying opposed axially directing forces to the flattened blown-film polymeric tube and thereby separating the trash bags comprising the flattened blown-film polymeric tube at each of the transversely extending line of perforations positioned between the closely spaced, parallel seals;

following the separation step, positioning the leading sealed end of the following trash bag comprising the flattened blown-film polymeric tube in an overlapping relationship with the trailing sealed end of the preceding trash bag comprising the flattened blown-film polymeric tube;

applying opposed axially directing forces to the flattened blown-film polymeric tube and thereby separating the trash bags comprising the flattened blown-film polymeric tube along each wave shaped line of perforations formed therein;

following the separating step positioning the leading wave-cut end of the following trash bag comprising the flattened blown-film polymeric tube in an overlapping relationship with the wave-cut trailing end of the preceding trash bag comprising the flattened blown-film polymeric tube; and rolling the trash bags comprising the flattened blown-film polymeric tube into a roll with the sealed end of each following trash bag in the roll overlapping the sealed end of each preceding trash bag in the roll and with the wave-cut open end of each following trash bag in the roll overlapping the wave-cut open end of the preceding trash bag in the roll.

2. The roll of trash bags constructed in accordance with claim 1.

3. The process according to claim 1 wherein the step of directing a signal through the perforations formed in the flattened blown-film polymeric tube is carried out by directing an electromagnetic beam through the perforations formed in the flattened blown-film polymeric tube.

4. The process according to claim 1 wherein the step of directing a signal through the perforation formed in the flattened blown-film polymeric tube is carried out by directing an electric spark through the perforations formed in the flattened blown-film tube.

5. The process according to claim 1 wherein the wave shaped lines of perforations which are formed in the flattened blown-film polymeric tube to define the open ends of the trash bags comprising the flattened blown-film polymeric tube are arranged in accordance with a predetermined pattern which eliminates force concentrations when the opposed axially directed forces are applied to the flattened blown-film polymeric tube to separate the trash bags comprising the flattened blown-film polymeric tube along the wave shaped lines of perforations formed therein.

6. The process according to claim 1 is further characterized by applying a predetermined electrostatic charge to the wave-cut ends of the trash bag comprising the flattened blown-film polymeric tube prior to the step of positioning the leading wave-cut end of the following trash bag in an overlapping relationship to the trailing wave-cut end of the preceding trash bag comprising the flattened blown-film polymeric tube.

* * * * *

UNITED STATES PATENT AND TRADEMARK OFFICE

CERTIFICATE OF CORRECTION

PATENT NO. : 7,048,224 B2
APPLICATION NO. : 10/644326
DATED : May 23, 2006
INVENTOR(S) : Charles D. Allgood It is certified that error appears in the above-identified patent and that said Letters Patent is hereby corrected as shown below:

On the Title Page (73)
The Assignee name on the patent should appear as follows:

Olympic General Corporation, Henderson, NV 89002

Signed and Sealed this

Twenty-fourth Day of April, 2007

JON W. DUDAS
*Director of the United States Patent and Trademark Office*